United States Patent [19]

Borjeson

[11] 4,141,189

[45] Feb. 27, 1979

[54] METHOD OF AND MEANS FOR SEALING EXPANSION AND CONTRACTION JOINTS OF BUILDINGS AND PAVEMENTS

[76] Inventor: Jan T. Borjeson, 3250 Laguna St. #104, San Francisco, Calif. 94123

[21] Appl. No.: 799,104

[22] Filed: May 20, 1977

[51] Int. Cl.[2] ..... E04B 1/68; E01C 11/10

[52] U.S. Cl. ..... 52/396; 404/64

[58] Field of Search ..... 52/396, 573; 404/48, 404/64–69, 87

[56] References Cited

U.S. PATENT DOCUMENTS

| | | | |
|---|---|---|---|
| 3,923,411 | 12/1975 | Berghman | 404/64 |
| 3,960,462 | 1/1976 | Kerschner | 404/64 |

FOREIGN PATENT DOCUMENTS

| | | | |
|---|---|---|---|
| 259000 | 9/1967 | Austria | 404/64 |
| 678685 | 1/1964 | Canada | 52/396 |

*Primary Examiner*—James L. Ridgill, Jr.

*Attorney, Agent, or Firm*—Phillips, Moore, Weissenberger, Lempio & Majestic

[57] ABSTRACT

A novel method is disclosed for installing elongated hollow resilient sealing members in the expansion and contraction joints of buildings and pavements by exerting force through an opening in the wall thereof on a limited area of the interior surface of the hollow resilient sealing members to cause their hollow cross-sectional dimensions to expand into the joint and contract transversely of the joint. Structural modifications of elongated hollow resilient sealing members required to adapt them for installation by the novel method are described. Novel sealing members having structural features required for installation by the novel method are disclosed.

3 Claims, 10 Drawing Figures

METHOD OF AND MEANS FOR SEALING EXPANSION AND CONTRACTION JOINTS OF BUILDINGS AND PAVEMENTS

BACKGROUND OF THE INVENTION

This invention relates to the sealing of expansion and contraction joints in buildings and pavements by installing elongated hollow resilient sealing members in such joints and more particularly to a novel method of installing such sealing members and the novel structural features required in such sealing members for installation by the novel method.

In the construction of buildings, highways, and the like in which concrete panels, slabs or sections are used, provision must be made for the expansion and contraction of the panels, slabs or sections due to changes in temperature, moisture content, etc. Thus, an appropriate spacing is provided between such panels, slabs or sections and adjacent structural elements, including other panels, slabs or sections. The channels or grooves formed by such spacing are conventionally sealed against entry of fluids and solids therein.

Initially, attempts were made to provide a satisfactory seal by forcing solid elastic material into the channel or groove. However, the range of expansion or contraction that can be accommodated without destroying the integrity of the seal was found to be small in view of the limited elastic characteristics of materials capable of providing a reasonable useful life when exposed to the harsh environment to which the exterior surfaces of buildings and pavements are subjected.

An early attempt to increase the range of expansion and contraction that could be accommodated was to preform the elastic material into an elongated sheet which was then forced into the channel or groove by folding the sheet along its axis of elongation. Thus, the resilience of the preformed sheet as a body, in addition to the elastic characteristics of the material, tended to increase the range of expansion and contraction that could be accommodated.

However, the contact area which provides the seal between the folded sheet and the sides of the channel tended to decrease rapidly when the channel widened. Thus, it has been proposed to preform the sealing member as an elongated resilient body of hollow cross-section and preferably of elastic material. An elongated body of hollow cross-section can be shaped to provide essentially constant contact area with the sides of the channel throughout the range of expansion and contraction to be accommodated thereby.

However, the installation of preformed elongated members of hollow cross-section has presented a problem in that such hollow cross-section must be collapsed to enable them to be installed in the channel. Although a folded sheet may be forced into the channel by placing it over the channel and applying pressure to a limited area thereof over the channel, the installation of a hollow body is more complicated. The application of pressure to the opposite side of a hollow body from the channel will simply cause the body to deform and bind against the sides of the channel. Thus, it has been proposed to collapse the hollow body by various means to enable it to be installed in the channel. For example, special tools for squeezing the hollow body transversely of the channel, or special means for evacuating the interior of the hollow body have been proposed. It has also been proposed to design the hollow body in such a way as to allow it to be pulled rather than pushed into the channel by appropriate tools received in the channel.

However, all of the methods and means for installing hollow bodies have required expensive, complicated and inconvenient tools and methods including specially shaped or dimensioned channels. Since thousands of feet of elongated hollow sealing members may be required on a given structure and, in the case of a building, such sealing members must be installed in locations which may be inconvenient and often at some height above the ground, it is necessary that a simple and convenient method be provided which does not require expensive and complicated tools or specially formed channels.

It is an object of this invention to provide an improved method of installing elongated hollow resilient sealing members in the expansion and contraction joints of buildings and pavements.

It is known in the prior art to provide elongated sealing members of both the folded type and the hollow type with various forms of projections or fingers on the exterior thereof adapted to engage the sides of the expansion and contraction joint in order to improve the seal therebetween. It is also known in the prior art to provide the interior of hollow resilient sealing members with various arrangements of struts and ribs adapted to maintain the compressive force exerted by the sealing member on the sides of the joint. However, bodies having external projections or internal ribs and struts are difficult to preform due to the difficulty of curing the elastic material which forms the projections, ribs and struts.

Another object of this invention is to provide improved elongated hollow resilient members which are not only suitable for installation by the improved method but which can be more easily and inexpensively preformed and cured than was possible according to the teaching of the prior art.

SUMMARY OF THE INVENTION

Briefly, this invention is an improvement in the art of sealing the elongated expansion and contraction joints of buildings and pavements which comprise a channel or groove of given width and height dimensions between adjacent structural elements through the use of preformed elongated resilient bodies having hollow cross-sections of greater width than the width of the channel to be sealed and height dimensions less than the height of the channel. In accordance with the teaching of this invention, an elongated rectilinear opening is provided through the wall of the preformed elongated resilient bodies which opening is parallel to the axis of elongation of the body and provides access to the interior of the hollow cross-section thereof. Engagement means are provided in the body on opposite sides of the opening which means cooperate when engaged to transfer stresses imposed on the body at one side of the opening to the other side of the opening.

According to the teaching of this invention, an elongated tool having cross-sectional dimensions which are small in comparison to the hollow cross-section of the elongated body is inserted through the opening in order to engage the interior surface of the hollow cross-section opposite the opening. Movement of the tool through the opening with respect to the engagement means on opposite sides thereof will cause the elongation of the body along its height dimension and contraction of the body along its width dimension thereby enabling the body to be forced into the channel of the expansion and contraction joint. Upon removal of the tool, the body will tend to be locked in place within the channel and any stresses in the body resulting from force applied to the body on one side of the opening will be transmitted to the other side of such opening through the cooperating engagement means thereby avoiding asymmetrical distortion of the body and impairment of the seal between the body and the sides of the channel of the expansion and contraction joint.

BRIEF DESCRIPTION OF THE DRAWING

The foregoing and other objects and features of this invention will be more fully understood from a reading of the following detailed description of preferred embodiments of the invention as shown in the attached drawing wherein.

DETAILED DESCRIPTION OF PREFERRED EMBODIMENTS

Figure 1:
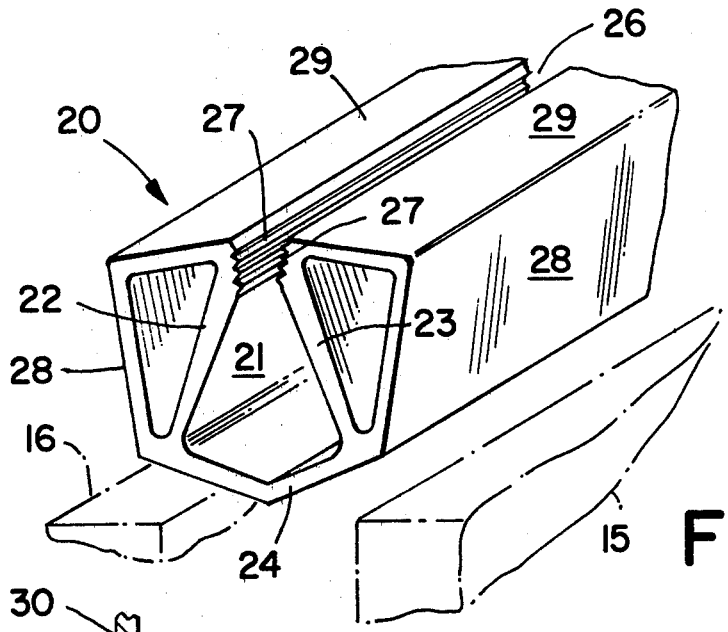
FIG. 1 is a perspective view of an end portion of an elongated resilient sealing member in accordance with one embodiment of this invention in position to be inserted into an expansion joint indicated in phantom.

FIGS. 1 through 5 illustrate the sealing of an expansion and contraction joint in accordance with one embodiment of this invention. The phantom lines in FIG. 1 present a fragmentary showing of an end portion of an expansion and contraction joint between adjacent structural elements 15 and 16 of a building or pavement. An end portion of an elongated resilient body 20 in accordance with this invention is shown in full positioned over the expansion joint between the structural elements 15 and 16. The structural elements 15 and 16 may be, for example, adjacent slabs of concrete or the like and the expansion and contraction joint is a channel or groove therebetween which allows the structural elements 15 and 16, as well as other structural elements of the building or pavement, to expand and contract causing the structural elements 15 and 16 to move toward or away from each other.

As shown in FIG. 1, the elongated resilient member 20 comprises a hollow cross-section 21 defined by a pair of walls 22 and 23 joined to each other at one of their ends by a bridging wall 24. The other ends of the walls 22 and 23 are not joined to each other and thus provide an opening 26 into the hollow cross-section defined by the walls 22 and 23 with the bridging wall 24. The free ends of the walls 22 and 23 are provided with engagement means 27 at the opening 26 which engagement means 27 are adapted to cooperate with each other when in engagement to transmit stresses imposed on the body 20 on one side of the opening 26 to the other side of the opening 26. According to this embodiment of the invention, the engagement means 27 comprises a plurality of grooves formed in the free ends of the walls 22 and 23 and adapted to interlock with each other when the free ends of the walls 22 and 23 are brought into engagement.

According to this invention, the relationship between the interior surfaces of the walls 22 and 23 must be such that they not only cooperate with the bridging wall 24 to provide the necessary hollow cross-section but also provide for the engagement of the free ends thereof directly over the center line of the bridging wall 24. According to this invention, the hollow resilient body 20 must be symmetrical on opposite sides of a plane passing through the center line of the bridging wall 24 and the line of engagement between the free ends of the walls 22 and 23.

The elongated resilient body 20 includes means formed integrally with the walls 22 and 23 for compressively engaging the sides of the channel formed by the expansion and contraction joint between the structural members 15 and 16. The walls 22 and 23 could simply be dimensioned to provide exterior surfaces adapted to engage the sides of the channel formed by the structural members 15 and 16 when installed. However, this would be wasteful of material and would tend to make the resilient body 20 undesirably rigid during installation and subsequent use as well as complicating the curing of the body where it is made of elastic material. Thus, in the embodiment of this invention shown in FIGS. 1 through 5, the walls 22 and 23 are made hollow, thus providing auxiliary walls 28 and 29 with the exterior surface of auxiliary wall 28 being adapted to engage the sides of the channel formed by the structural members 15 and 16 and auxiliary wall 29 adapted to bridge between the free ends of the walls 22 and 23, respectively, and the associated auxiliary wall 28.

Figure 2:
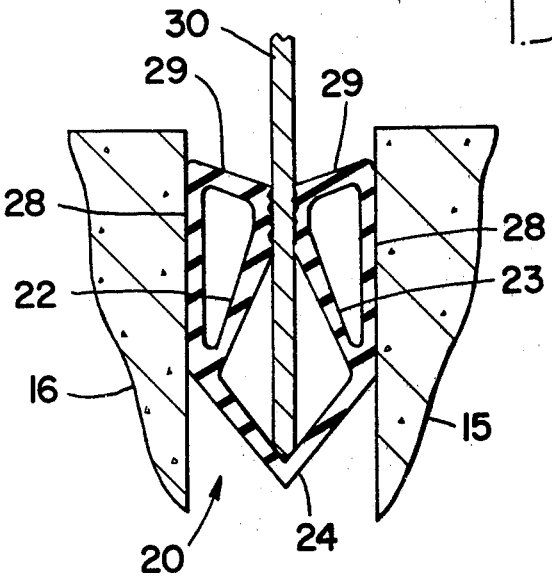
FIG. 2 is a cross-sectional view of the elongated resilient member of FIG. 1 upon insertion into the expansion joint with the insertion tool shown in engagement therewith.

The resilient body 20 is dimensioned so that its cross-sectional width is larger than the width of the channel between the structural members 15 and 16 into which it is to be installed. Similarly, the resilient body 20 is dimensioned so that its cross sectional height is less than the depth of the channel between the structural members 15 and 16 to enable the body 20 to be fully received therein. As best shown in FIGS. 1 and 2, the resilient body is installed in the expansion and contraction joint between the structural members 15 and 16 by positioning it over the channel defined thereby with the elongated opening between the free ends of the walls 22 and 23 aligned with the center line of the channel. A smooth sided tool 30 is then inserted through the elongated opening 26 and into contact with the interior surface of the bridging wall 24 at the center line thereof. The tool 30 has a cross-sectional width substantially smaller than the cross-sectional width of the hollow cross-section defined by the walls 22 and 23 with the bridging wall 24. The tool 30 may be, for example, a circular disc having a radius substantially greater than the cross-sectional height of the resilient member 20 mounted for rotation on a handle whereby a substantial force may be exerted on a limited area of the interior surface of the bridging wall 24. As shown in FIG. 2, the application of force on a limited area of the internal surface of the bridging wall 24 by means of the tool 30 will cooperate with frictional forces exerted on the exterior surfaces of the auxiliary wall 28 to cause the cross-sectional dimensions of the resilient body 20 to increase in height and decrease in width, thereby facilitating the installation of the resilient body 20 into the channel defined by the expansion and contraction joint between the structural members 15 and 16. The tool 30 will move with respect to the free ends of the walls 22 and 23 into the hollow cross-section defined thereby. Such movement of the tool 30 with respect to the free ends of the walls 22 and 23 will cooperate with the frictional forces exerted on the auxiliary walls 28 to cause the auxiliary walls 29 to deflect downwardly in the direction of movement of the tool 30.

As soon as the force is removed from the tool 30, resilient body 20 will tend to return to its normal shape against compressive contact with the sides of the channel formed by the expansion and contraction joint between the structural members 15 and 16. The tool 30 may then be removed since the frictional forces between the exterior surfaces of the walls 28 and the sides of the channel will exceed the frictional forces present between the sides of the tool 30 and the opening 26 at the free ends of the walls 22 and 23. The downward deflection of the auxiliary walls 29 will also help to insure that the resilient body 20 remains in place during removal of the tool 30 and the sides of the tool may be lubricated if necessary. Where the tool 30 is a disc that is moved along the length of the resilient body 20, the incremental insertion and removal of the tool 30 as it rotates will facilitate the installation of the resilient body 20 into the channel formed by the expansion and contraction joint between the structural members 15 and 16.

Figure 4:
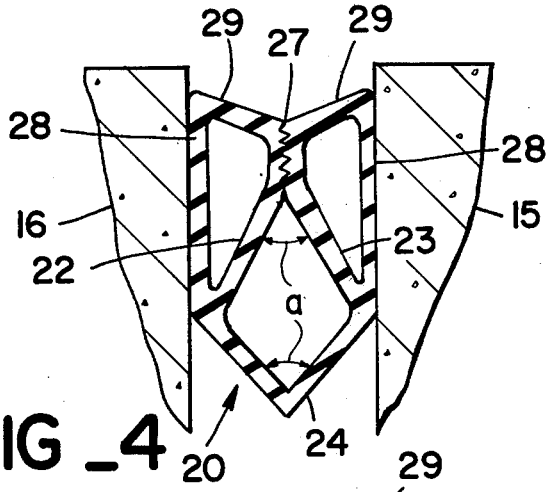
FIG. 4 is a cross-sectional view taken along lines 4—4 of FIG. 3.
Figure 3:
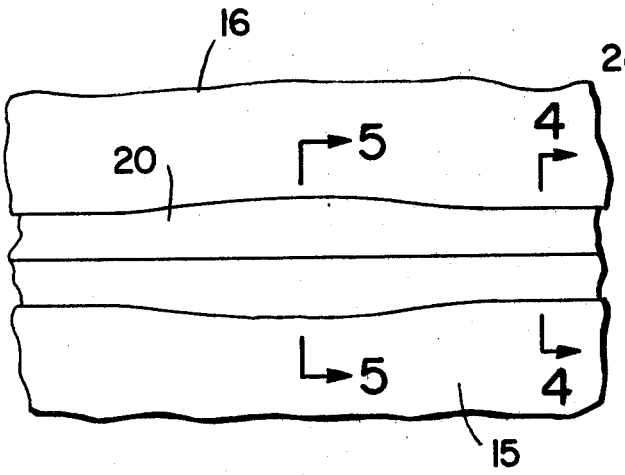
FIG. 3 is a fragmentary top plan view of an expansion and contraction joint with the elongated resilient member of FIG. 1 in place therein.
Figure 5:
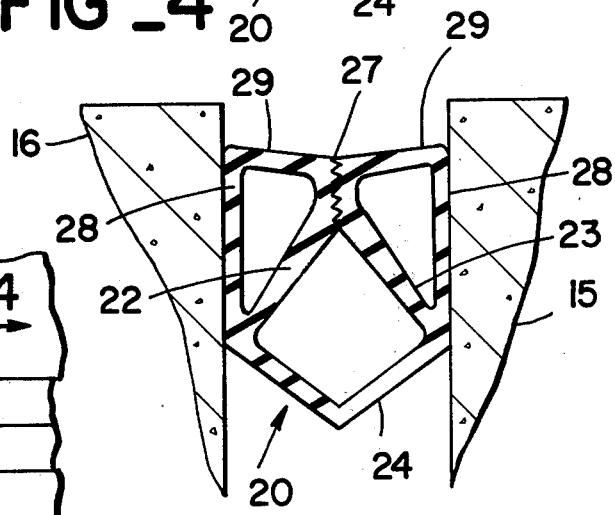
FIG. 5 is a cross-sectional view taken along lines 5—5 of FIG. 3.

Referring to FIGS. 3, 4 and 5, it will be seen that the hollow cross-section of the resilient body 20 will enable it to seal the channel formed by the expansion and contraction joint between the structural members 15 and 16 against the entry of fluids and liquids throughout its length over a substantial range of variations in width of such channel in addition to accommodating a substantial range of expansion and contraction. Upon removal of the tool 30 the engagement means 27 at the free ends of the walls 22 and 23 will interlock. Thus, forces which may be applied to the exterior surface of one or the other of the auxiliary walls 29 after the resilient body 20 has been installed into the channel will be transmitted through the engagement means 27 to the other side of the resilient body thereby preventing such force from tilting or cocking the resilient body 20 within the channel.

The resilient body 20 is preferably formed by extrusion techniques. In order to enhance the resilience of the body 20 it is preferably made of an elastic material such as rubber although plastics such as polyvinyl chlorides, polyurethanes and silicones could also be used. The opening 26 into the hollow cross-section 21 defined by the walls 22 and 23 with the bridging wall 24 facilitates the curing of the resilient body 20 after it has been extruded in addition to adapting the resilient body 20 for installation into the expansion and contraction joint according to this invention.

Figure 6:
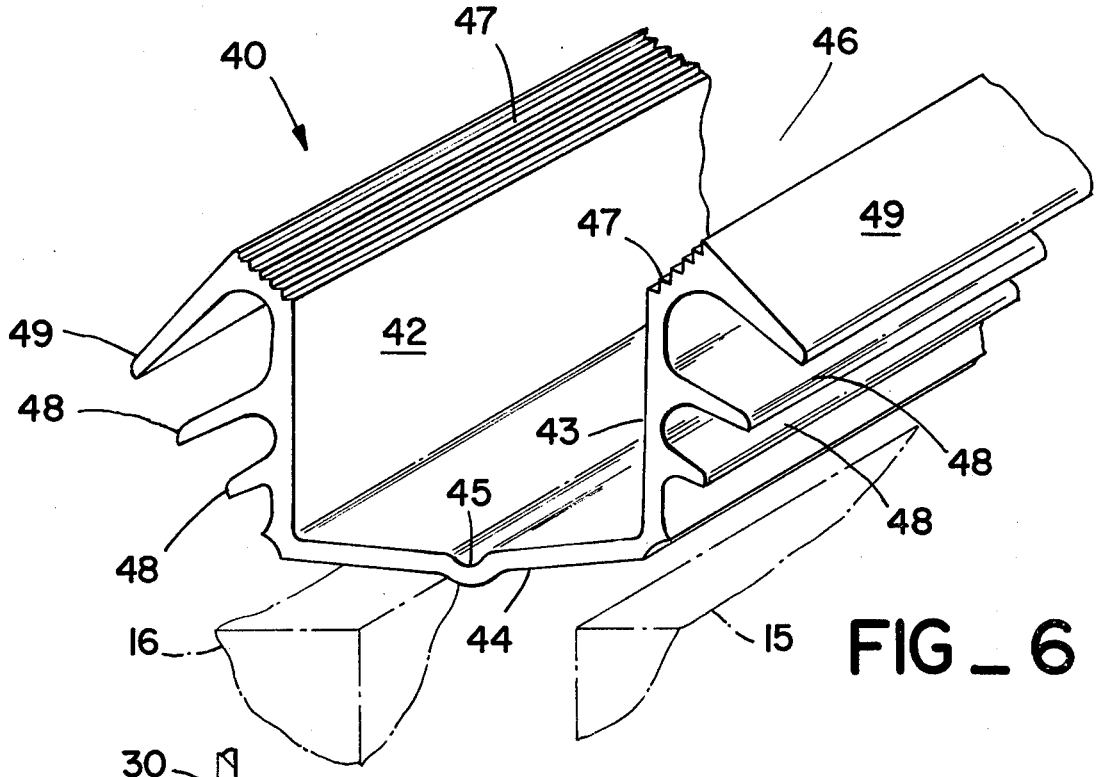
FIG. 6 is a perspective view of an end portion of an elongated resilient member in accordance with a second embodiment of this invention.
Figure 7:
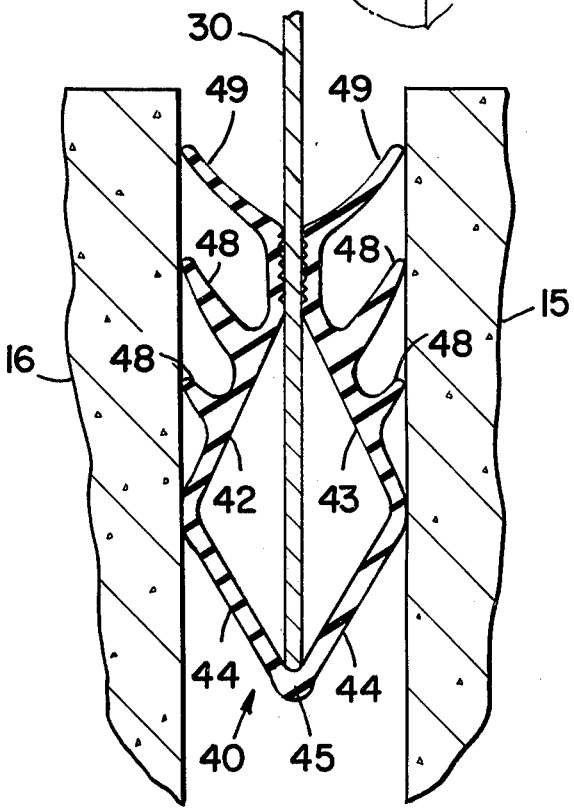
FIG. 7 is a cross-sectional view showing the resilient member of FIG. 6 in the process of being inserted into an expansion and contraction joint with the inserting tool in place.
Figure 8:
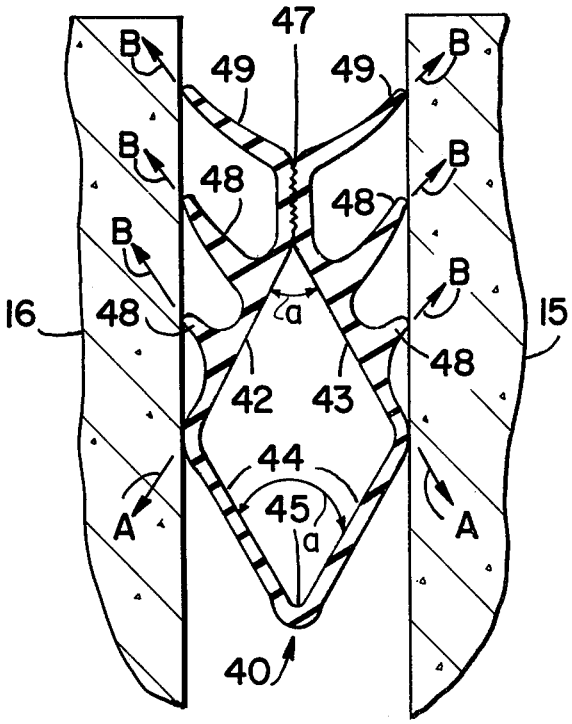
FIG. 8 is a cross-sectional view similar to FIG. 7 with the inserting tool removed.

Referring to FIGS. 6, 7, and 8, an embodiment of this invention is shown which is preferred for its economy of material and ease of extrusion as well as its improved sealing characteristics. According to this embodiment of the invention, an elongated resilient body 40 is extruded with side walls 42 and 43 and a bridging wall 44 having interior surfaces defining a simple generally rectilinear open channel. The exterior surface of the side walls 42 and 43 are provided with fingers or ribs 48 projecting outwardly and downwardly therefrom. The free ends of the walls 42 and 43 which define the opening 46 of the channel shape are provided with engagement means 47 in the form of a plurality of grooves in a surface extending at an angle to the walls 42 and 43 such that the grooves 47 will be brought into interlocking engagement when the walls 42 and 43 are pivoted toward each other about their joint with the bridging wall 44. A further finger or rib 49 is provided at the free end of each of the walls 42 and 43 projecting outwardly and downwardly from the grooved engagement surface 47.

The bridging wall 44 is dimensioned so that the external dimensions of the resilient body 40 at the joint between the bridging wall and the side walls 42 and 43 will be larger than the channel formed by the expansion and contraction joint between the structural members 15 and 16 into which the resilient body 40 is to be installed. The bridging wall 44 is preferably provided with an internal groove 45 along the center line thereof to facilitate the installation of the resilient body 40 into the channel formed by the expansion and contraction joint.

As best shown in FIGS. 6 and 7, the resilient body 40 is installed in the expansion and contraction joint by positioning it over the channel between the structural members 15 and 16 and placing an elongated tool 30 of small cross-sectional dimensions with respect to the cross-sectional dimensions of the channel in contact with the groove 45 in the internal surface of the bridging wall 44. As described hereinabove, the tool 30 may be a relatively thin smooth sided disc having a radius substantially greater than the height of the resilient body 40 when installed. The tool 30 is forced against the bridging wall 44 bringing the joint between the side walls 42 and 43 with the bridging wall 44 into contact with the structural members 15 and 16. The tool 30 is moved into the channel between the structural members 15 and 16 with the force applied to the tool 30 cooperating with frictional forces between the resilient body 40 at the exterior thereof and the sides of the channel formed by the structural members 15 and 16 to deflect the bridging wall 44 downwardly at its center line 45 causing the joints between the walls 42 and 43 with the bridging wall 44 to approach each other thereby facilitating the entry of the resilient body 40 into the channel between the structural members 15 and 16. As the resilient body 40 enters the channel between the structural members 15 and 16, the ribs 48 projecting from the walls 42 and 43 will be deflected upwardly and the increased friction will produce a further deflection of the bridging wall 44 to further facilitate the entry of the resilient body 40 into the channel.

When the resilient body 40 has entered the channel between the structural members 15 and 16 a sufficient distance to bring the ribs 49 into contact with the sides of the channel as shown in FIG. 7, the engagement means 47 at the free ends of the walls 42 and 43 will be brought into contact with the sides of the tool 30. The ribs 49 will be deflected upwardly by contact with the sides of the channel between the structural members 15 and 16 and the tool 30 will move with respect to the engagement means 47 into the hollow cross-section defined by the walls 42 and 43 with the bridging wall 44 to produce a further contraction in the width of such hollow cross-section thereby continuing to facilitate the installation of the resilient body 40 into the channel.

When the resilient body 40 is fully received within the channel between the structural members 15 and 16, the tool 30 is removed. As shown by the arrows labeled A in FIG. 8, the resilient body 40 will be locked against further movement into the channel between the structural members 15 and 16 by the engagement between the side walls of the channel and the joints between the walls 42 and 43 with the bridging wall 44. Similarly, as indicated by the arrows labeled B, the resilient body 40 will be locked against removal from the channel by the engagement of the upwardly deflected ribs 48 and 49 with the sides of the channel.

As described hereinabove, the removal of the tool 30 may be facilitated by lubrication of the smooth sides thereof and upon removal of the tool the engagement means 47 will interlock as shown in FIG. 8. Thus, forces applied to one or the other of the ribs 49 will be transmitted through the engagement means 47 the opposite side of the body 40 thereby resisting the tendency of such a force to displace one side of the body 40 with respect to the other side thereof.

The resilient body 40 is preferably extruded of EPDM or neoprene resilient rubber material. It will be seen that the open structure of the resilient body 40 will facilitate thorough and rapid curing after extrusion. It will also be seen that the shape of the resilient body will provide sealing characteristics approaching optimum over a wide range of expansion and contraction or variations in width of the channel between the structural members 15 and 16. Fluid or liquid pressure acting on the resilient body 40 when received in the channel between the structural members 15 and 16 will tend to force the ribs 48 and 49 more tightly against the sides of such channel and in addition, will increase the force indicated by the arrow labeled A in FIG. 8.

Figure 9:
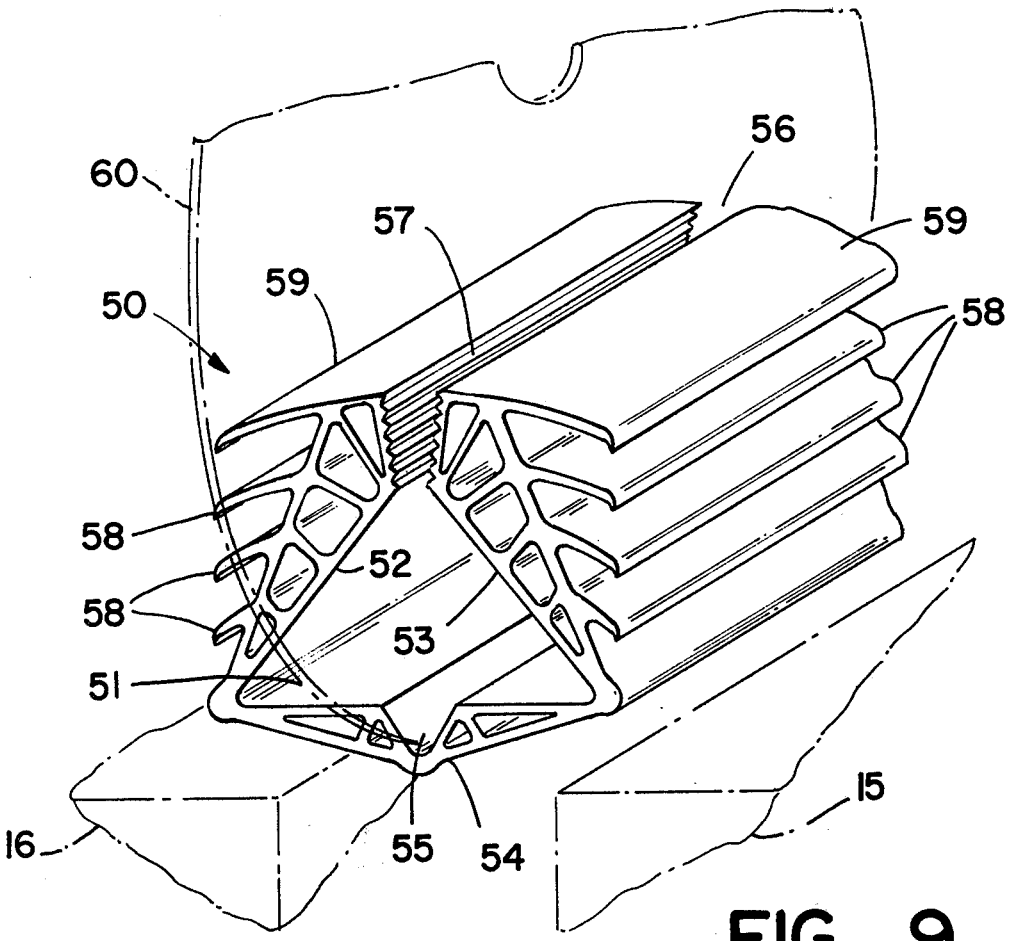
FIG. 9 is a perspective view of an end portion of an elongated resilient member in accordance with a third embodiment of this invention in position to be inserted in an expansion and contraction joint indicated in phantom.
Figure 10:
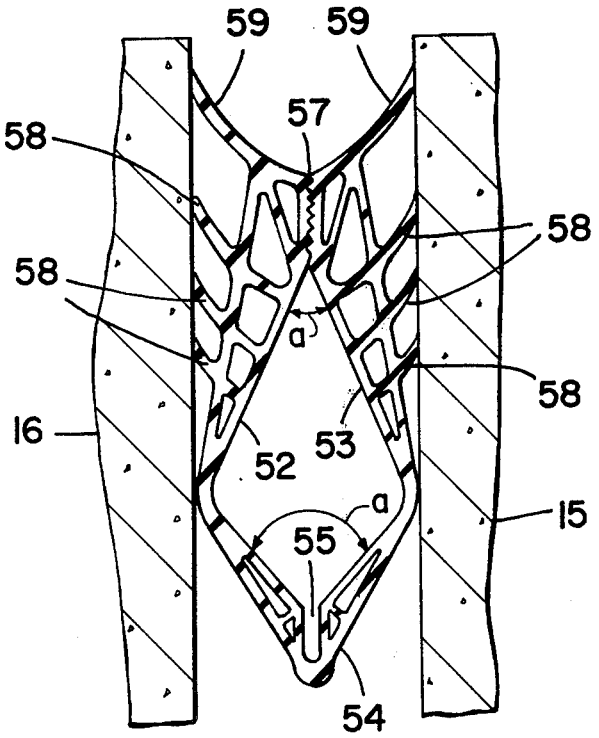
FIG. 10 is a cross-sectional view showing the resilient member of FIG. 9 in place within the expansion and contraction joint.

FIGS. 9 and 10 illustrate an embodiment of this invention suitable for use in sealing expansion and contraction joints between structural members 15 and 16 where the channel defined thereby has relatively large width. The elongated resilient body 50, according to this embodiment of the invention, combines structural features discussed hereinabove in connection with the resilient bodies of embodiments 20 and 40. Thus, the side walls 52 and 53 as well as the bridging wall 54 of the resilient body 50 comprise hollow webbed sturctures to conserve material and yet provide the strength necessary in view of the large size of the body 50. A substantial groove 55 is provided along the center line of the bridging wall 54 to insure positive guidance of the relatively large resilient body 50 into the channel between the structural members 15 and 16. The opening 56 at the free ends of the walls 52 and 53 opposite the groove 55 as well as the engagement means 57 associated therewith function in the same way as the corresponding elements of resilient bodies 20 and 40. Similarly, the fingers or ribs 58 and 59 on the exterior of the resilient body 50 function in the same way as corresponding elements of the embodiment 40. A tool 60 for installing the body 50 in the form of a smooth sided circular disc is shown in phantom in FIG. 9. The tool for installing other embodiments of this invention could be similarly formed.

It will be noted that the hollow cross-section defined by the internal surfaces of the side walls and bridging wall of resilient bodies 20, 40 and 50, when installed, are all generally diamond shaped even though the two sides bonding one of the acute angles a (alpha) may be shorter than the other two sides. Although a hollow cross-section of such shape is preferred according to the teaching of this invention, it should be emphasized that hollow cross-sections resulting in other shapes could also be used without departing from the teaching of this invention. It is only necessary that the hollow cross-section be dimensioned and shaped to permit the resilient body to be deformed by movement of the tool through the opening and against the internal surface of the bridging wall in such a way that the width of the resilient member will be symmetrically decreased on opposite sides of the tool by the resultant increase in the height of the resilient member. For this reason, and since the side walls are formed integrally with the bridging wall and are provided with integral means for making sealing contact with the side walls of the channel defined by expansion and contraction joints, it may be difficult to make physical distinctions between the essential structural elements of a resilient member according to certain embodiments of the teaching of this invention. It is believed that those skilled in the art will make various obvious changes in the specific embodiments disclosed in the drawing and specifically described hereinabove without departing from the teaching of this invention. Thus, the term "hollow cross-section" as used herein is defined as any cross-section enabling the body to be elongated in one dimension of any given cross-sectional plane thereof with a resultant contraction in the transverse dimension thereof in such given plane. The terms "side walls" and "bridging wall" as used herein, are defined to include all structural shapes capable of providing a hollow cross-section as defined herein. Thus, even though the side walls and bridging wall are formed integrally with each other and no exact demarcation therebetween can be physically identified, when installed according to this invention a substantial portion of the hollow cross section of the body must project into the expansion and contraction joint with respect to a plane passing through the innermost points of contact between the body and the sides of the joint and at least that part of the body defining such substantial portion of the hollow cross-section thereof constitutes the "bridging wall" as the term is used herein.

What is claimed is:

1. In the method of sealing an elongated expansion and contraction joint of buildings and pavements comprising an open channel having a cross-section of given maximum width and given minimum height between adjacent building and pavement panels and slabs by forcing therein a preformed elongated resilient body having a hollow cross-section and being of greater width than said maximum width and lesser height than said minimum height of said joint, the improvement comprising the steps of:

(a) providing an elongated rectilinear opening through the wall of said hollow elongated body parallel to the axis of elongation thereof;

(b) providing a plurality of engagement means on said elongated body on opposite sides of said opening adapted to cooperate with each other when in engagement to transmit stresses imposed on said body on one side of said opening to the other side of said opening;

(c) forming said hollow cross-section of said elongated resilient body so that the internal surfaces thereof define an acute angle at said opening when said engagement means are in engagement;

(d) positioning said elongated resilient body on said elongated joint with said elongated opening aligned with said joint on the opposite side of said elongated body from said joint;

(e) inserting a smooth sided tool through said opening between said engagement means and into contact with the internal surface of the wall of said elongated body opposite said slot and over said joint, said tool having a width smaller than the width of said hollow cross-section of said elongated resilient body and a height greater than the height of said hollow cross-section of said elongated resilient body;

(f) forcing said elongated resilient body into said joint by movement of said tool through said opening against said wall thereof opposite said opening, increasing said height of said hollow cross-section of said elongated resilient body and decreasing said width of said hollow cross-section of said elongated resilient body and removing said tool to allow said hollow cross-section of said elongated resilient body to tend to return to its original shape against compressive contact with the sides of said elongated joint and to allow said engagement means on opposite sides of said elongated opening to cooperate to transmit stresses subsequently imposed on said body on one side of said opening to the other side of said opening.

2. The improvement of claim 1 including the additional step of forming said hollow cross-section of said elongated resilient body so that the internal surfaces thereof define a generally diamond shape figure with an acute angle thereof at said opening.

3. In a sealing member for installation in an expansion and contraction joint of given maximum width and given minimum height, which sealing member comprises a preformed elongated body of elastic material having a hollow cross-section and being of greater width than said maximum width of said joint and lesser height than said minimum height of said joint, the improvement comprising:

(a) an elongated rectilinear opening through the wall of said hollow cross-section of said elongated body of elastic material parallel to the axis of elongation of said body; and (b) a plurality of engagement means on said elongated body of elastic material on opposite sides of said opening adapted to cooperate with each other when in engagement to transmit stresses imposed on said body on one side of said opening to the other side of said opening; and (c) the internal surfaces of said hollow cross-section of said elongated body of elastic material defining a generally diamond shape figure having an acute angle thereof at said opening and said body being symmetrical on opposite sides of a plane passing through the apex of said acute angle.

* * * * *